US005341758A

United States Patent [19]

Strickland

[11] Patent Number: 5,341,758

[45] Date of Patent: Aug. 30, 1994

[54] SURFING ROPE

[76] Inventor: David A. Strickland, 8754 Sand Point Way NE., Seattle, Wash. 98115

[21] Appl. No.: 760,767

[22] Filed: Sep. 16, 1991

[51] Int. Cl.[5] ..... B63B 35/85

[52] U.S. Cl. ..... 114/253; 87/6; 441/84; 441/69; 441/133

[58] Field of Search ..... 114/253, 254; 441/69, 441/84, 85, 133; 57/906; 87/6, 7

[56] References Cited

U.S. PATENT DOCUMENTS

| | | | |
|---|---|---|---|
| 411,161 | 9/1889 | Maynard | 441/84 |
| 2,368,558 | 1/1945 | Maloney | 441/84 |
| 3,486,409 | 12/1969 | Powell | 87/6 |
| 3,642,277 | 2/1972 | Gersten | 272/60 |
| 3,795,096 | 3/1974 | Dunwoody, Jr. | 57/144 |
| 4,161,998 | 7/1979 | Trimble | 182/190 |
| 4,426,908 | 1/1984 | Ullmann | 114/253 |
| 4,789,045 | 12/1988 | Pugh | 182/190 |
| 5,016,516 | 5/1991 | Aldrich et al. | 87/8 |

FOREIGN PATENT DOCUMENTS

| | | | |
|---|---|---|---|
| 266790 | 9/1964 | Australia . | |
| 79242 | 1/1895 | Fed. Rep. of Germany | 441/132 |
| 2381 | of 1883 | United Kingdom | 441/133 |
| 15723 | of 1887 | United Kingdom | 441/133 |

OTHER PUBLICATIONS

Modular Deck, *Popular Science,* Jul. 1982, pp. 88–89.

*Overton's 1991 Water Sports Catalog,* Cover page plus pp. 28–31.

*Primary Examiner*—Michael S. Huppert

*Assistant Examiner*—Thomas J. Brahan

*Attorney, Agent, or Firm*—Christensen, O'Connor, Johnson & Kindness

[57] ABSTRACT

A surfing rope (20) for towing a surfer behind a boat or upon moving water is disclosed. The surfing rope is constructed from a length of braided rope (22) having a plurality of nodules (24) intermittently spaced along the rope's length for gripping by the surfer. The nodules are formed by a plurality of inserts (26) strung on to an inner cord (34) that is threaded through the braided rope.

15 Claims, 4 Drawing Sheets

22
24
26
32
34
36
38
40
42
44
46
48
50
52
54
56
58
60
62

SURFING ROPE

TECHNICAL AREA OF THE INVENTION

The invention relates to a rope for towing a person behind a moving vehicle or upon moving water and, more particularly, to a surfing rope having a plurality of spaced enlargements along its length for gripping by a surfer being towed behind a boat or by a surfer riding rapids or moving water.

BACKGROUND OF THE INVENTION

Proficiency in surfing can only be obtained by practice. However, in regions of the country where the waves necessary for surfing are unavailable, wave conditions are poor, or access is inconvenient, it is necessary to turn to any alternative source for waves. One alternative source of waves derives from the use of watercraft, typically motorboats. Waves are formed by the stem wake of a boat as the boat moves through the water. Different magnitudes of waves can be generated depending upon the speed of the boat and the hull design.

In certain instances, the waves produced are of sufficient magnitude to support surfing practice. The waves simulate natural wave motion, but are generally insufficient to propel a surfer along. Thus, the wake surfer grips a tow rope secured to the stern of the boat, and rides a surfboard on the waves generated by the boat while being towed behind the boat. The wake surfer is able to grip the rope with one or both hands while still maintaining the traditional surfing body position.

In order to wake surf different sections of the wave and thus practice different surfing technique, the wake surfer should preferably be able to vary his or her distance from the stem of the boat while maintaining a secure grip on the tow rope. Additionally, the wake surfer needs to be able to easily vary his or her posture (which generally is facing perpendicular (sideways) to the path of travel) as the surfer moves up and down various positions on the stem wake.

Typically wake surfing has been practiced with the aid of conventional water-skiing tow ropes. Such conventional tow ropes typically consist of a long length of rope, often a polypropylene braided rope, having a handle, such as a stirrup or bar, integrated into one end. The other end of the rope is securable to the boat. Although the tow rope length may be varied by securing the rope to the boat at differing points along the rope's length, once the tow rope is secured, the length of the rope is fixed. If a wake surfer were to grasp the rope at a point other than the handle, so as to change the distance between the surfer and the boat, the rigid handle is left to knock about the surfer. The transverse bar or stirrup handle of conventional water-skiing tow ropes also does not facilitate grasping the rope when standing up in a traditional surfing posture.

Further, no gripping device other than the handle is provided at other points on conventional water-skiing tow ropes. Thus a wake surfer is unable to obtain a firm grasp at points along the length of the rope to prevent the rope from sliding through the surfer's hands. Some conventional water-skiing tow ropes have a thickened section adjacent the handle that would provide for a somewhat firmer grip, but still do not provide a way to assuredly prevent slippage of the rope. Thus, conventional water-skiing tow ropes are inappropriate for a wake surfer who wishes to vary his or her distance from the end of the motorboat, and posture, while surfing.

In a further type of surfing, individuals stand on wooden platforms or surfboards in the swift currents and rapids of fast moving streams and rivers. A "river surfer" holds on to a rope tied to a rock, tree or other stationary object. The river surfer maneuvers himself/herself about the currents and rapids by "working" the board in a manner similar to the surfer being towed behind a boat, i.e., the river surfer shifts his/her weight and moves his/her position relative to the board and also moves back and forth along the length of the restraining rope.

To date the restraining rope used by river surfers is typically composed of a basic climbing rope. Thus the rope must be secured to the board or very tightly grasped to prevent the rope from sliding through the river surfer's hands.

SUMMARY OF THE INVENTION

The present invention provides a surfing rope for towing a wake surfer behind a watercraft or for enabling a river surfer to move about the currents and rapids of a river or stream. The surfing rope is constructed from a line having a plurality of nodules spaced intermittently along its length.

In a further aspect of the present invention, the tow line comprises a braided rope having a hollow interior. Intermittently spaced nodules are created within the braided rope by insertion of shaped inserts within the hollow interior of the rope, thereby expanding the diameter of the rope at the locations of the rope coveting the inserts.

In a still further aspect of the present invention, the inserts each include a longitudinal central passageway, enabling the inserts to be strung on an inner cord. The cord is then threaded thru the braided rope to secure the inserts and prevent them from sliding within the rope.

A surfing rope constructed in accordance with the present invention facilitates wake surfing behind a moving watercraft and river surfing upon rapidly moving water. The surfer can grasp the rope at a selected nodule, or between nodules, thereby enabling the surfer to adjust the distance between the surfer and the watercraft. The increased diameter of the rope at the nodule locations enables the surfer to securely grasp the rope at the desired position. The surfer's clenched hand can be positioned to but against the forward side of a selected nodule, thereby preventing the surfer's hand from sliding rearwardly along the length of the rope. Construction of nodules within a tow rope in accordance with the present invention does not require the integration of a stirrup handle or other rigid transverse grip within the rope, which if present could interfere with the surfer if allowed to dangle while surfing.

Additionally, an adjustable grip rope constructed in accordance with the present invention may be used for trick skiing, kneeboarding, recreational activities on moving bodies of water, or similar activities which benefit from the ability to grip the rope at different points.

BRIEF DESCRIPTION OF THE DRAWINGS

The foregoing aspects and many of the attendant advantages of this invention will become more readily appreciated as the same becomes better understood by reference to the following detailed description, when taken in conjunction with the accompanying drawings, wherein.

DETAILED DESCRIPTION OF THE PREFERRED EMBODIMENT

Figure 1:
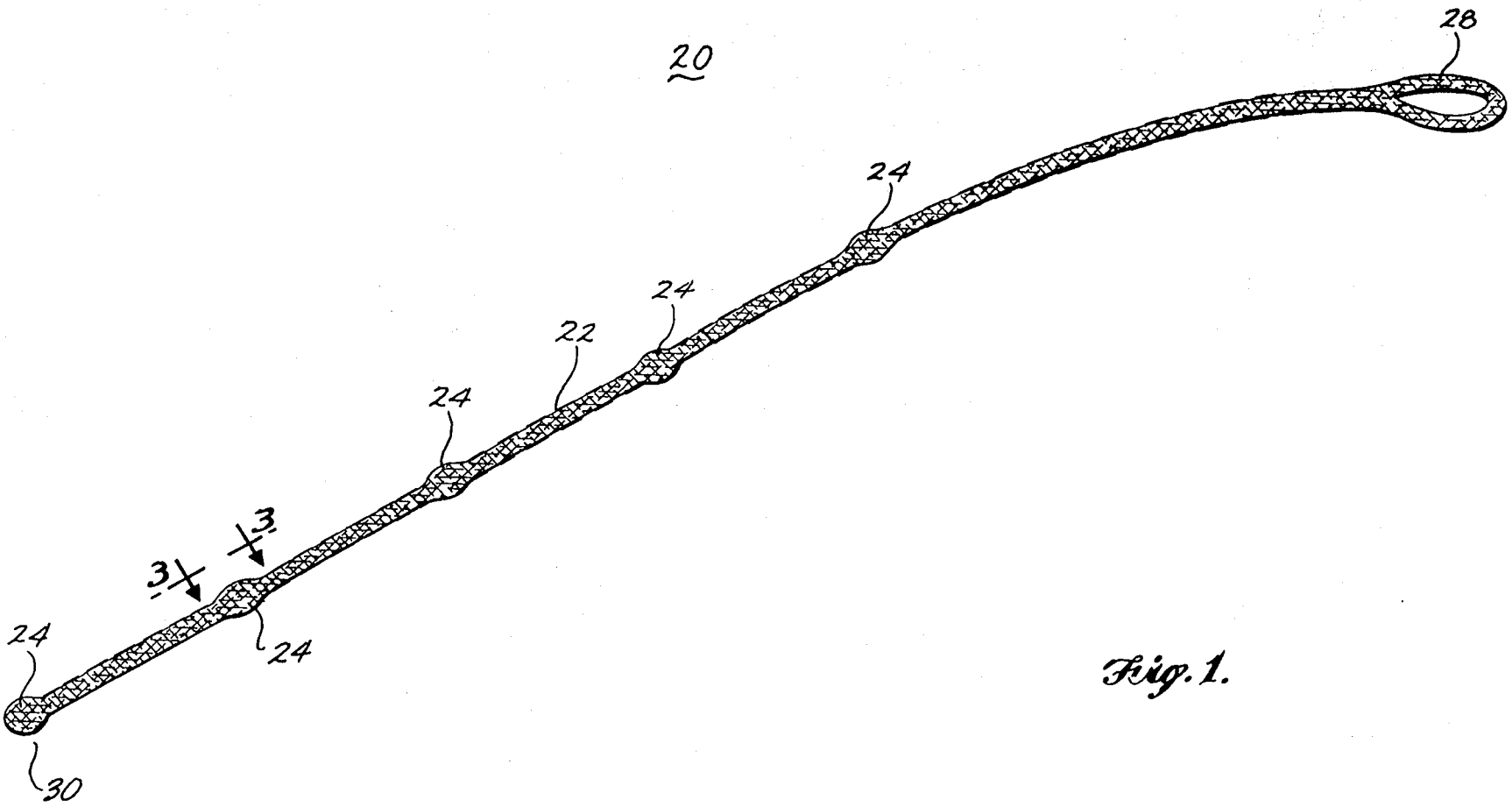
FIG. 1 is a pictorial view of a surfing rope constructed in accordance with the present invention.

A first preferred embodiment of a surfing rope 20 constructed in accordance with the present invention is shown in FIG. 1. The surfing rope 20 is formed from a length of line, such as a braided rope 22. A plurality of nodules 24, having a diameter greater than that of the remainder of the braided rope 22, are spaced intermittently along the length of at least a portion of the surfing rope 20.

Conventional braided rope has a flexible tubular wall defining a hollow interior. Braided rope may be bunched by longitudinally compressing the rope, thereby increasing the rope's diameter. The nodules 24 within the surfing rope 20 are preferably created by the insertion of inserts 26, shown in FIGS. 2 and 3, within the hollow interior of the braided rope 22. The inserts may also be inserted by temporarily spreading the braided rope at the intended location of the nodule. The inserts 26 have a diameter greater than the nominal internal diameter of the braided rope 22. Thus the portion of the braided rope 22 covering a corresponding insert 26 is enlarged in diameter, creating a gripping nodule 24.

The braided rope 22 is preferably constructed from strands of a material that is positively buoyant in water, such as polypropylene. Although the number of strands and diameter of the braided rope is not critical, it has been found that braided 24 strand polypropylene rope having a nominal external diameter of from $\frac{7}{8}$ to 1 and $\frac{1}{8}$ inch is especially well suited for use with the present invention. Smaller diameters may be better suited for use by children. This construction of a braided rope 22 provides a thick hand-hold between the nodules 24. In use, a surfer can grasp the surfing rope 20 adjacent the leading, forward side of a nodule, with the users cuffed hand buffing against the nodule 24, thus preventing the users hand from sliding rearwardly along the length of the surfing rope 20. (As used herein, forward refers to the direction facing a boat towing a surfer, while rearward refers to the opposite direction.) Alternately, a surfer can clench his or hand around a nodule 24, also providing a secure handhold.

It should be readily apparent that other rope materials instead of polypropylene can be utilized, such as cotton or nylon. Further, it should also be apparent that other types of expandable tubular sleeving can be utilized in place of the braided rope, such as extruded elastomeric sleeving. Factors affecting such choices include quality of grip, buoyancy, stretch, flexibility and weight.

Figures 2, 3, 4, 5, 6, 7:
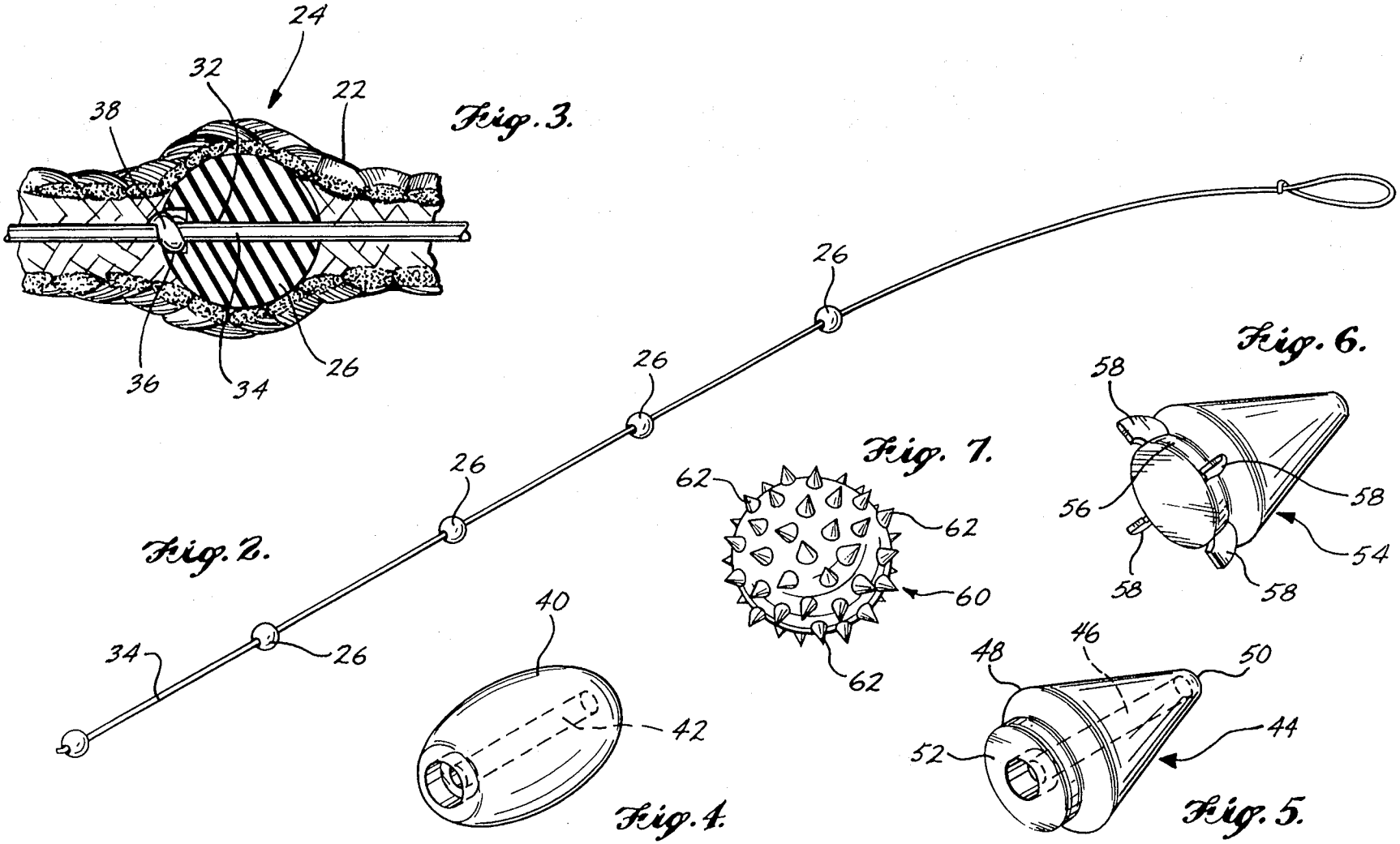
FIG. 2 is a pictorial view of an inner cord strung with spherical inserts for assembly within a braided rope to construct the surfing rope of FIG. 1.
FIG. 3 is a cross sectional view of a spherical insert strung on the inner cord within the braided rope, taken substantially along line 3—3 of FIG. 1.
FIG. 4 is an alternate ovoid embodiment of an insert.
FIG. 5 is an alternate conical embodiment of an insert.
FIG. 6 is an alternate embodiment of a conical insert including hooked flanges for engaging with a braided rope covering.
FIG. 7 is an alternate spherical embodiment of an insert including a plurality of radial projections for engaging with a braided rope covering.

Referring to FIGS. 2 and 3, the inserts 26 illustrated are spherical shaped. The diameter of the inserts 26 must be greater than the internal diameter of the braided rope 22 when the rope is under tension. Preferably, the insert 26 has a diameter approximately equivalent to the nominal outside diameter of the braided rope 22. For example, a 1.0 inch nominal braided rope 22 is well adapted to receive inserts of between about 0.9 and 1.2 inches to construct a surfing rope in accordance with the present invention.

Though not essential, the inserts 26 may be constructed from a positively buoyant material, particularly when the rope has low buoyancy. Also, it is preferable to construct the inserts 26 from a resilient material, such as an elastomer, thereby enabling a surfer to compress the nodules 24, and also avoiding injury to the surfer if the surfer is hit by the nodules 24. A heavy weight, closed cell foamed rubber may be utilized for added buoyancy.

Referring to FIG. 1, the forward end of the surfing rope 20 is formed into an attachment loop 28. In use, the attachment loop 28 is secured to the trailing end of a longer extension tow rope, such as a conventional water-ski tow rope. The other end of the water-ski tow rope is secured to the stem of a boat. For "river" surfing on moving water, the loop 28 facilitates attachment of the rope to an extension rope that is secured to a stationary object, such as a tree or rock alongside or within the water.

Typically, a wake surfer will be towed approximately ten to forty feet behind the stem of the boat. The length of the surfing rope can be determined as desired depending on the propulsion equipment of the boat, wave shape, board length and expertise. The length of the surfing rope 20, measure from a trailing end 30 of the surfing rope 20 to the attachment loop 28, is typically between five and ten feet. The number and spacing of the nodules 24 can also be determined as desired. Ideally the length of the portion of the rope 20 including the nodules 24 is no longer than the distance between a user's feet and hip, plus six inches, so as to avoid the rope from becoming entangled around the user's legs.

One preferred configuration for a surfing rope 20 is a seven foot total length, including five nodules 24 periodically spaced eight to twelve inches apart along the length of the surfing rope 20, with a first nodule 24 being formed within the trailing end 30 of the surfing rope 20. A most preferred configuration is to construct a surfing rope 20 having five nodules 24 spaced eight inches apart (resulting in a forty inch long noduled portion) and a thirty-six inch lead portion terminating at the attachment loop 28, for a total rope length of about seventy-six inches. A shorter rope, such as five feet in length with five nodules placed eight inches apart, may be preferred for smaller users. Other length and nodule spacing variations are possible, depending on the user.

A preferred method of placing the inserts 26 within the braided rope 22 shall now be described with reference to FIGS. 2 and 3. A longitudinal central passage 32 is formed through each insert 26. An inner line or cord 34 is passed thru the central passages 32, thereby stringing the inserts 26 onto the cord 34. The cord 34 is preferably knotted periodically, adjacent the rear side of each insert 26. The inserts 26 preferably each include a counter bore 36, formed in the rear side of the insert 26 about the passage 32, that receives a corresponding knot 38 of the cord 34.

The cord 34 strung with the inserts 26 is then threaded through the interior of the braided rope 22 to form the nodules 24. The knots 38, being larger than the diameters of the passages 32 formed within the inserts 26, serve as stops to prevent the inserts from sliding rearwardly on the cord 34 during use. The cord 34 can also be knotted on the forward sides of the inserts 26. However, as there is no forward longitudinal force exerted on the nodules during use, the constriction of the braided rope 22 around the inserts 26 has been found sufficient to prevent forward sliding of the inserts 26 within the braided rope 22.

It should also be apparent that the inserts 26 may be connected together in accordance with the present invention by a method other than that previously described. For example, adjacent inserts 26 could be connected by short lengths of cord (not shown), with each end of the cord being anchored to one end of an insert 26.

Although the inserts 26 have been described thus far as being spherical, it should be apparent that various other shapes of inserts may be utilized. For example, FIG. 4 shows an ovoid insert 40 having an axial passage 42 formed there through for stringing on to an inner cord.

As a further example, FIG. 5 shows a conical insert 44. The conical insert 44 includes an axial passage 46 for stringing on to an inner cord. The conical insert tapers from a rear end 46 of the insert to a generally pointed forward end 50. The pointed end 50 provides for ease of insertion into a braided rope, as previously described, and also provides a comfortable grip for the surfer. Thus, a surfer can either grip around the braided rope-covered conical insert 44, or grip the braided rope forwardly of the conical insert 44, with the conical insert 44 acting as a wedge to prevent the surfer's hand from sliding rearwardly. The conical insert 44 further includes a stepped-down cylindrical shank portion 52, formed centrally at the rear end 48 of the insert. The shank portion 52 enables a braided rope 22 or other expandable sleeve to make a more gradual transition from the expanded diameter of a nodule formed by the insert to the sleeve's nominal diameter. Various other shapes for inserts can be readily envisioned, such as cylindrical inserts.

Although the inserts 26, 40 and 44 have thus far been described as preferably threaded onto an inner cord 34, other methods of securing the inserts within the braided rope 22 can be used. For example, inserts 26, 40 or 44 can be positioned independently of adjacent inserts at intervals within the braided rope 22. It has been found that the constriction of the expanded braided rope 22 about the inserts, especially when the rope is under tension during use, is sufficient to hold the inserts in position, although not as securely as when the inserts are threaded onto a knotted inner cord. For independent insertion of the inserts, it would not be necessary to provide central passageways within the inserts, and the inner cord 34 would be omitted.

To more securely position independent inerts 26, 40 or 44 within the braided rope 22, the exterior surface of the inserts may be provided with a rough texture or a plurality of radial projections. The external surface then coacts with voids present in the braided rope 22 to prevent the inserts from sliding within the braided rope 22.

For example, FIG. 6 shows a conical insert 54 that is constructed similarly to the conical insert 44 of FIG. 5, with two exceptions. The conical insert 54 does not include a central passage. Secondly, the shank portion 56 on the rear end of the conical insert 54 includes a plurality of radial flanges 58 spaced around its circumference. Each flange 58 has a hooked shape, so that the flange is angled rearwardly. Thus, during insertion of an insert 54 into a braided rope 22, the insert 54 is able to slide forwardly without the flanges 58 catching. However, in the opposite direction the flanges 58 tend to catch within and between the strands of the braided rope 22 to prevent the insert 54 from sliding rearwardly within the braided rope 22.

As a further example of an insert having a surface texture to prevent slippage, FIG. 7 shows a spherical insert 60 formed to include a plurality of pointed nubs 62 projecting radially outward on the insert's external surface. Again, the nubs 62 catch in the braided rope 22 to secure the inserts 60 in position. Various other surface textures can be utilized, such as a coarsely knurled surface.

Whether the inserts are strung on to an inner cord 34, as for inserts 26, 40 and 44, or inserted independently, as for inserts 54 and 60, several methods of insertion within the braided rope 22 can be employed. First, the inserts may be inserted into the rope 22 by bunching the rope 22 to loosen the braiding. Following loosening of the braiding, the inserts may be inserted between the braids, axially (for inserts strung onto a cord or loose inserts) or radially inwards (for loose inserts), followed by retightening of the braid. Alternatively, the inserts can be inserted by braiding the ropes strand bundles around the inserts during manufacture of the rope 22. After insertion of the inserts, the rear end 30 is sealed and the attachment loop 28 is formed using standard splicing techniques.

Figure 8:
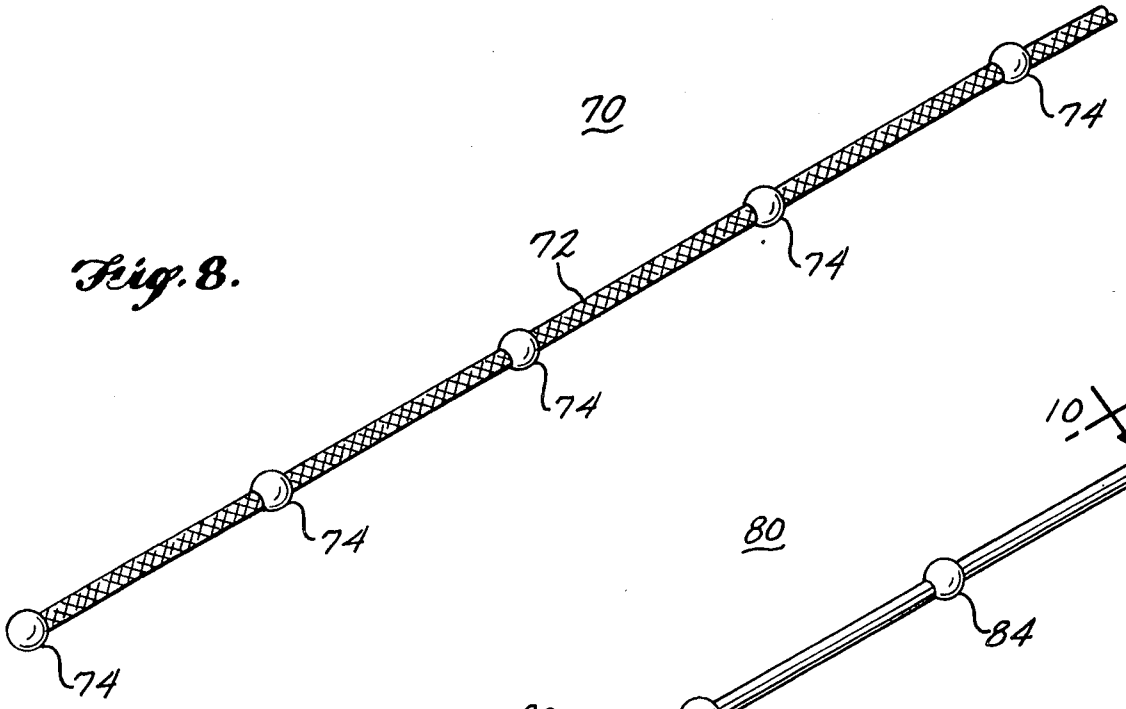
FIG. 8 is an alternate embodiment of a surfing rope having nodules formed by annular grips secured on the exterior of the rope.

Rather than forming nodules in a surfing rope by the insertion of inserts within an expandable sleeve, other methods of periodically enlarging a rope's diameter may be employed. For example, FIG. 8 shows a portion of a surfing rope 70 formed from a length of braided rope 72. Annular grips 74 are secured about the braided rope 72 to form gripping nodules. In the embodiment illustrated, the annular grips 74 have a generally spherical shape, although other shapes, such as conical, with or without tapered flanges, or ovoid, are possible. The annular grips 74 are preferably formed from an elastomeric material. The annular grips 74 may be adhered to the outside of the braided rope 72, or alternately may be molded directly onto the rope 72, with the grip 74 material thereby being forced between the braids of the rope 72 to secure the grips 74 in position. Rather than a braided rope 72, other types of line, such as twisted-strand rope, may be employed.

Figure 9:
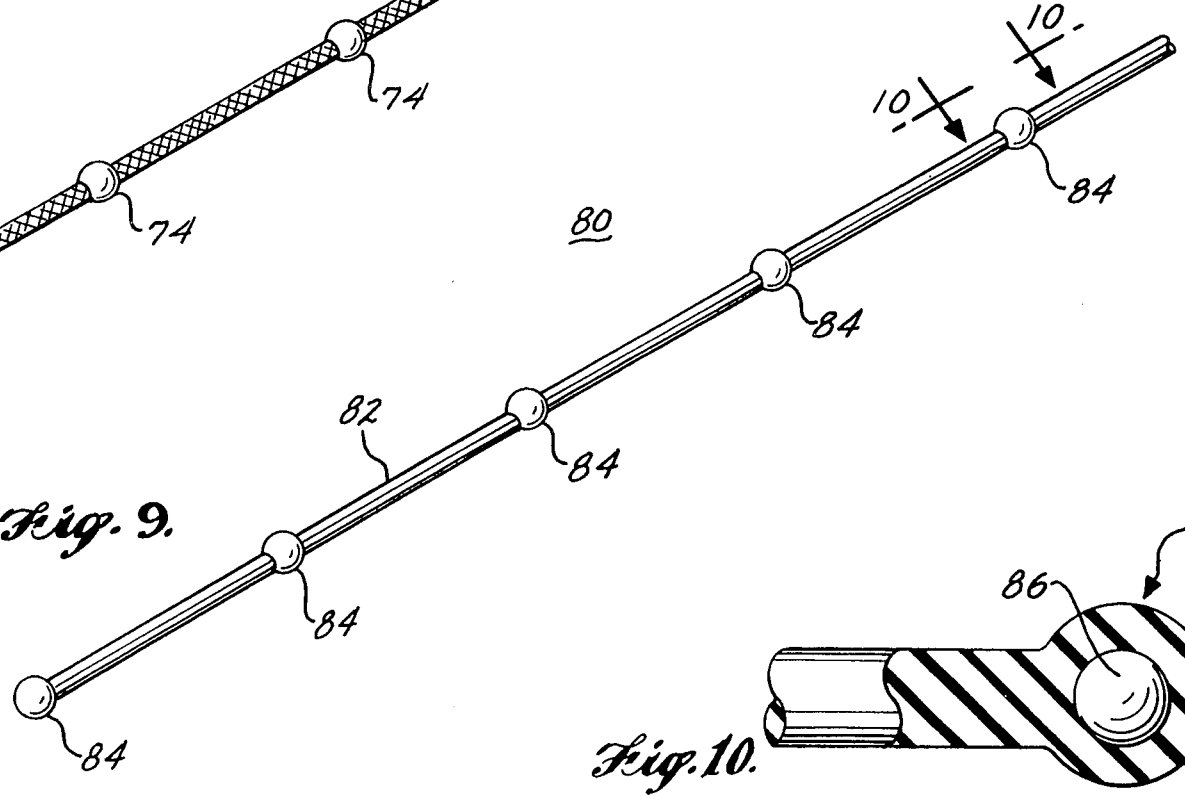
FIG. 9 is a further alternate embodiment of a formed elastomeric surfing rope.

As a further alternate construction, FIG. 9 shows a surfing rope 80 having a line portion 82 and intermittently spaced nodules 84 formed or molded integrally as a singular unit. The overall external shape of the surfing rope 80 is similar to that of the surfing rope 20 shown in FIG. 1. However, the line portion 83 and nodules 84 are preferably constructed from an elastomeric material. The surfing rope 80 may be reinforced with internal filamentary strands.

Figure 10:
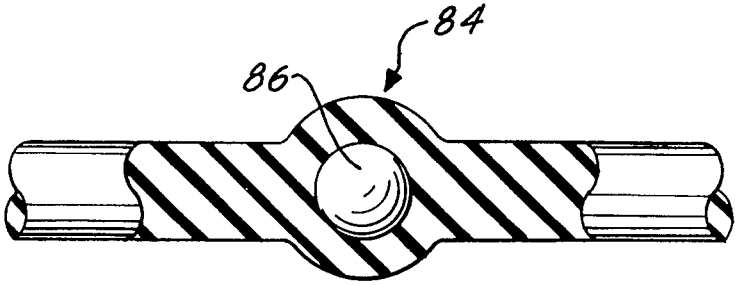
FIG. 10 is a cross sectional view of a hollow insert imbedded within an elastomeric surfing rope, taken substantially along line 10—10 of FIG. 9.

It is preferable that the surfing rope 80 be positively buoyant. Thus, all or at least a portion of the elastomeric material used to mold or otherwise form the surfing rope 80 should have a density low enough to ensure floatation of the rope 80. Alternately, a low density insert, such as the foamed elastomeric sphere 86, may be imbedded within each nodule 84 for additional buoyancy, as shown in FIG. 10. Also, it should be apparent that the interior of the nodules 84 of the surfing rope 80 can instead be hollow.

Figures 11, 12:
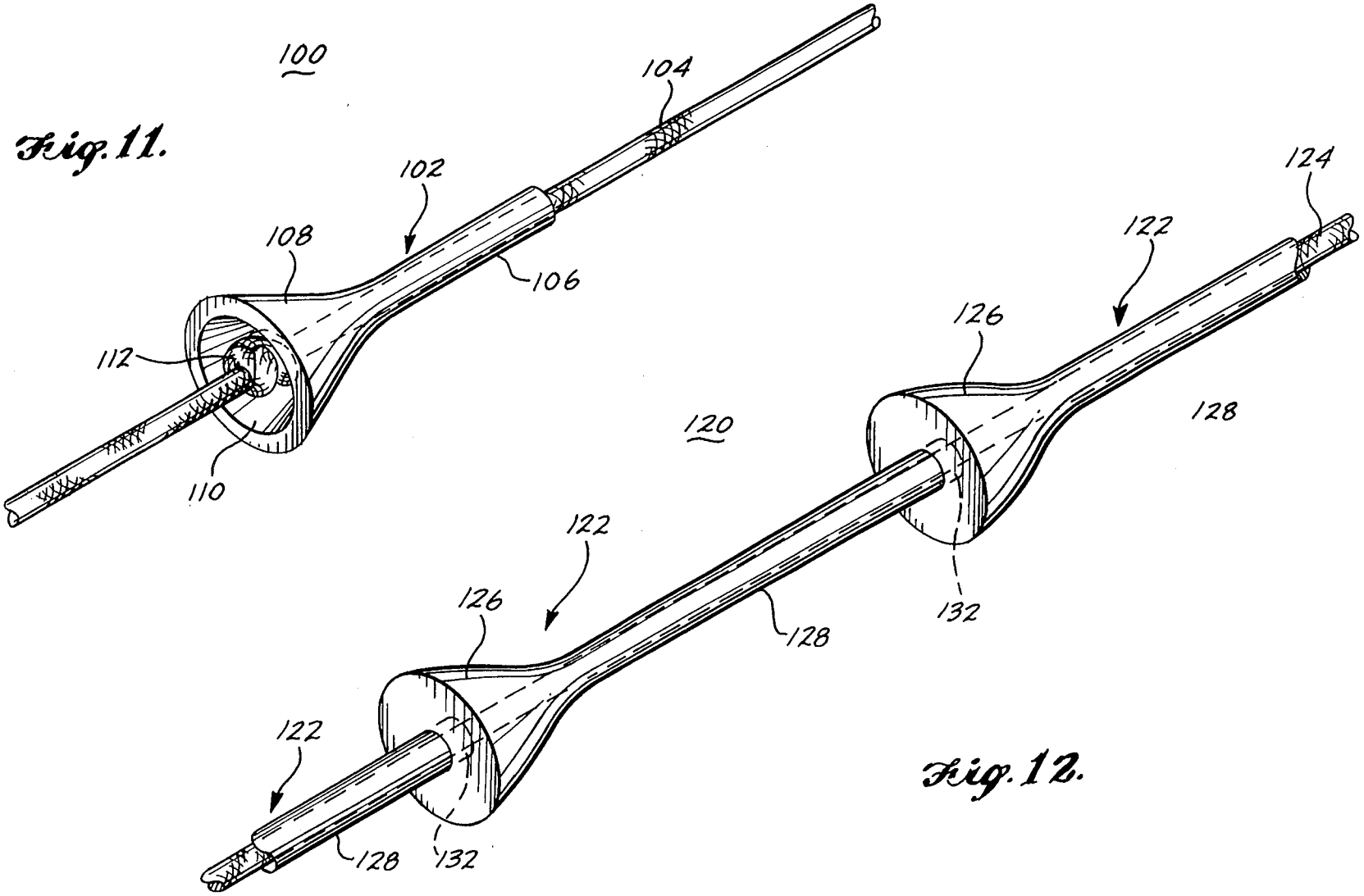
FIG. 11 is a pictorial view of an alternate embodiment of a surfing rope having tapered hand grips spaced along the length of a rope.
FIG. 12 is a pictorial view of a modification of the embodiment of FIG. 11, wherein the tapered hand grips are elongated and nest within each other for purposes of location on the rope.

A still further alternate construction of a surfing rope 100 is shown in FIG. 11. The surfing rope 100 comprises a plurality of tapered hand grips 102 that are threaded on to a rope 104, and are secured at periodic intervals along the ropes length. Each tapered hand grip 102 includes an elongate forward section 106 that tapers forwardly from an enlarged, radially outwardly flared or funnel-shaped rearward portion 108. A central concave-shaped cavity 110 formed in the rearward face of the hand grip 102 receives a knot 112 formed in the rope to prevent the hand grip 102 from sliding rearwardly along the length of the rope 104. In use, a user can wrap his or her hand around the elongate forward portion 106, with the palm of the users hand butting against the enlarged rearward portion 108 to prevent slipping of the users hand. The length of the hand grips 102 are preferably about six to seven inches long to accommodate an adult user, but could be smaller for children. The hand grips 102 may be formed from a variety of materials, such as a compressible firm foam to a hard elastomer.

A still alternate variation on the surfing rope 100 is the surfing rope 120 shown in FIG. 12. The surfing rope 120 comprises a plurality of hand grips 122 threaded on to a length of rope 124. The hand grips 122 are configured similarly to the hand grips 102 of the surfing rope 100, with several differences. The hand grips 122 include a rearward, outwardly flared, enlarged portion 126 that tapers forwardly to form an elongate gripping portion 128. The elongate gripping portion 128 is longer than the gripping portions 106 of the hand grips 102 of the surfing rope 100, thereby permitting the hand grips 122 to be axially stacked along the length of the rope 124.

The outwardly flared, rearward portion 126 of each hand grip 122 includes a cavity 132 formed on the hand grip's rearward face. The forward tip of an adjacent hand grip 122 is received within the cavity 132 of the next hand grip 122 to provide a positive interconnection between the two hand grips. The material used for the hand grips 122 is preferably an elastomer which is flexible enough to allow the rope 120 to be easily bent, yet stiff enough to prevent the hand grips 122 from being axially compressed.

The length of the hand grips 122 is sufficient such that the enlarged ends 126 define periodic nodules along the length of the rope 124. For example, the hand grips 122 may be approximately eight to twelve inches long, depending on the desired spacing of the nodules.

As a variation of the surfing rope 120, the rope can be constructed such that the hand grips 122 are molded together to form a continuous, integral member. The gripping portions of the hand grips can be of solid construction for greater structural integrity or hollow for reduced density and greater buoyancy. In either case, the need for the central rope 124 is eliminated.

While the preferred embodiment of the invention and several variations thereof have been illustrated and described, it will be appreciated that various other alterations, changes, and substitutions of equivalents can be made, in view of the disclosure herein, without departing from the spirit and scope of the invention. Thus, it is intended that the scope of the present invention be limited only by the definitions contained in the appended claims and the equivalents thereof.

The embodiments of the invention in which an exclusive property or privilege is claimed are defined as follows:

1. A surfing rope for towing a suffer behind a watercraft, comprising:

a tow line comprising an expandable tubular sleeve defining a hollow interior;

means for defining a plurality of nodules spaced intermittently along at least a portion of the length of the tow line, said portion having a discontinuous profile defined by enlarged diameter nodules spaced apart by smaller diameter segments of the tow line so that the tow line can be gripped at selected nodules or between spaced nodules, wherein the means defining nodules includes a plurality of shaped inserts capable of being inserted within the hollow interior of the sleeve to expand the diameter of the sleeve at locations covering the inserts, the shaped inserts having a length and diameter predetermined to be substantially contained within the hand of a user grasping the rope at a nodule and being substantially nonelongatable when grasped, whereby the suffer can securely grip the tow line at selected nodules while under dynamic towing conditions;

means for securely retaining the inserts within the sleeve to prevent the inserts from sliding within the sleeve during dynamic loading of the tow line, wherein adjacent inserts are spaced apart a distance exceeding the length of each insert; and wherein the surfing rope is of buoyant construction.

2. The surfing rope of claim 1, wherein the means for retaining the inserts includes an inner cord extending between adjacent inserts within the interior of the tubular sleeve.

3. The surfing rope of claim 1, wherein the tubular sleeve comprises a braided rope.

4. The surfing rope of claim 3, wherein the braided rope is constructed from a buoyant material.

5. The surfing rope of claim 3, wherein the inserts are constructed from a buoyant material.

6. The surfing rope of claim 3, wherein the inserts are constructed from an elastomeric material.

7. The surfing rope of claim 1, wherein:

the inserts each define a longitudinal passage; and the means for retaining the inserts comprises an inner cord onto which the inserts are strung by passage of the inner cord through the passages of the inserts, the inner cord including a plurality of stops, a stop being formed on the inner cord adjacent a first side of each insert to prevent the insert from sliding on the inner cord in the direction toward the stop, the inner cord and inserts strung thereon capable of being threaded through the hollow interior of the braided rope.

8. The surfing rope of claim 7, wherein the inner cord is knotted periodically to form the stops, the inserts each including a cavity defined within the first side of the insert about the central passage to receive a knot of the cord therein.

9. The surfing rope of claim 7, wherein the shaped insert is selected from the group consisting of spherical inserts, ovoid inserts and conical inserts.

10. The surfing rope of claim 1, wherein the means for retaining the inserts includes a plurality of projections formed on the exterior of each insert to catch within the tubular sleeve when the tubular sleeve is placed in tension.

11. The surfing rope of claim 10, wherein each insert includes a plurality of flanges projecting radially outwards from the exterior of the insert, the flanges being angled towards a first side of the insert.

12. The surfing rope of claim 1, wherein the tow line has one end adapted for attachment to an extension line that is securable to the watercraft.

13. A tow rope for towing a person behind a moving vehicle, comprising:

an expandable tubular sleeve defining a hollow interior;

a plurality of shaped inserts capable of being inserted within the hollow interior of the sleeve at predetermined intervals along the length of the sleeve to expand the diameter of the sleeve at locations covering the inserts, thereby creating a plurality of enlarged diameter gripping nodules along the length of the sleeve spaced apart by smaller diameter segments of the tow line so that the tow line has a discontinuous profile and can be gripped at selected nodules or between spaced nodules, wherein the inserts have a predetermined length and diameter so that the gripping nodules are substantially contained within the hand of a user grasping a gripping nodule and being substantially nonelongatable when grasped, whereby a person can securely grip the tow line at selected nodules while under dynamic towing conditions;

means for securely retaining the inserts within the sleeve to prevent the inserts from sliding within the sleeve during dynamic loading of the tow line, wherein adjacent inserts are spaced apart a distance exceeding the length of each insert; and wherein the tow rope is of buoyant construction.

14. The tow rope of claim 13, wherein the tubular sleeve comprises a braided rope.

15. The tow rope of claim 14, wherein the inserts each define a longitudinal passage, the tow rope further comprising an inner cord onto which the inserts are strung by passage of the inner cord through the passages of the inserts, the inner cord including a plurality of stops, a stop being formed on the inner cord adjacent a first side of each insert to prevent the insert from sliding on the inner cord in the direction toward the stop, the inner cord and inserts strung thereon capable of being threaded through the hollow interior of the braided rope.

* * * * *